US005593052A

United States Patent [19]

McGee

[11] Patent Number: 5,593,052

[45] Date of Patent: Jan. 14, 1997

[54] BABY BOTTLE WITH TWO SEPARATE FLUID CHAMBERS

[76] Inventor: Michael McGee, 1711 E. 55th St., Chicago, Ill. 60615

[21] Appl. No.: 511,781

[22] Filed: Aug. 7, 1995

[51] Int. Cl.[6] ..... A61J 9/00; A61J 9/08; A61J 11/00

[52] U.S. Cl. ..... 215/11.1; 215/6; 215/11.4; 215/11.6

[58] Field of Search ..... 215/11.1, 11.4, 215/11.5, 6

[56] References Cited

U.S. PATENT DOCUMENTS

| | | | |
|---|---|---|---|
| D. 141,518 | 6/1945 | Porthouse et al. | 215/11.1 X |
| 1,425,539 | 8/1922 | Paulsen | 215/11.6 |
| 2,372,281 | 3/1945 | Jordan | 215/11.1 X |
| 2,745,568 | 5/1956 | Newton | 215/11.4 |
| 2,746,631 | 5/1956 | Witz | 215/11.1 |
| 3,211,315 | 10/1965 | Brifsinger | 215/11.1 |
| 3,337,073 | 8/1967 | Angelo | 215/6 |
| 3,385,297 | 5/1968 | Yazaki | 215/11.4 |
| 3,705,661 | 12/1972 | Davis | 215/6 |
| 4,600,111 | 7/1986 | Brown | 215/6 |
| 4,603,784 | 8/1986 | Chang | 215/11.1 |
| 4,685,577 | 8/1987 | Chen | 215/11.4 X |
| 4,703,863 | 11/1987 | Kohus | 215/11.1 |
| 4,778,068 | 10/1988 | Kohus | 215/11.1 |
| 4,856,995 | 8/1989 | Wagner | 215/11.1 X |
| 5,060,811 | 10/1991 | Fox | 215/11.4 X |
| 5,456,090 | 10/1995 | McCoy | 215/11.1 X |

FOREIGN PATENT DOCUMENTS

| | | | |
|---|---|---|---|
| 455605 | 8/1913 | France | 215/11.1 |
| 371167 | 4/1932 | United Kingdom | 215/11.1 |

*Primary Examiner*—Sue A. Weaver
*Attorney, Agent, or Firm*—David S. Thompson

[57] ABSTRACT

A two-sided baby bottle having a divided fluid container is disclosed. The divided fluid container allows the storage of two fluids, such as milk and juice, in a single baby bottle. A stopper, attached to an annular flange of a flexible nipple, is inserted into the opening of the cavity on one side of the bottle, preventing passage of fluid. A threaded collar, similar that used with prior art baby bottles, presses the flange of the nipple against the rim of the bottle, making a fluid-tight seal. A ring, supported by a stem connected to an anchor inside the stopper, allows the user to remove the stopper when desired, after removal of the threaded collar. The stopper may then be inserted into the opening of the second side of the bottle. The nipple, attached to the stopper, tends to prevent the stopper from being forced all the way into either half of the bottle.

7 Claims, 2 Drawing Sheets

BABY BOTTLE WITH TWO SEPARATE FLUID CHAMBERS

CROSS-REFERENCES

There are no applications related to this application filed in this or any foreign country.

BACKGROUND

A wide variety of baby bottles have been designed and sold. However, very few have had the vision to include structures to allow the storage of two fluids in one bottle. The advantages of having two different fluids in a single baby bottle are several: convenience, versatility, economy and practicality. Dental health may also be improved, since milk or sugar-based juices may be followed by water, which tends to wash away the decay producing substances present in milk or juice.

Of the few baby bottles which have included two cavities to carry two different fluids, all suffer from one or more problems. One problem shared by several such bottles is that the valving structure used to switch the flow to the nipple from one cavity to the other is either expensive or leaky, or both. To be commercially practical, a baby bottle must be lightweight and inexpensive. Given the generally flimsy nature of most inexpensive materials, it is likely that an inexpensive valve will leak. As a result, two-sided baby bottles having a valve typically will leak fluid from the side intended to be blocked into either the nipple, or the other side, or both.

A second problem common to prior art two-sided baby bottles is that two nipples are required, even though only one can be used at any given time. This is generally true of baby bottles having two opposed, in-line cavities, joined by their respective bases. Using one nipple for both fluids is more economical and results in a more compact design.

What is needed is a baby bottle having two fluid containing cavities and sharing one nipple. A leak-proof structure must be disclosed, so that the two fluids are not mixed as they enter the nipple, and so that they are not mixed in the bottle.

SUMMARY

The present invention is directed to an apparatus that satisfies the above needs. A novel baby bottle having two cavities, each cavity suitable for carrying a different fluid, is provided.

The baby bottle of the present invention provides:

(a) A two-sided bottle. The bottle is generally made of semi-rigid plastic, and provides:
  (a) A body portion.
  (b) A center divider. The center divider has a perimeter, which is attached to the body, thereby dividing the body into a left cavity and a right cavity. The two cavities are generally of equal volume, each having a capacity of approximately 4 to 8 ounces of liquid. And,
  (c) A cylindrical neck attached to the body. The neck additionally provides:
    (a) An inside portion and an outside portion.
    (b) A rim. The rim is generally circular.
    (c) Threads on the outside portion of the neck.

(d) A left opening. The left opening that is generally a half-circle in cross-section, and is formed by the cylindrical neck of the bottle and the straight center divider. And,
    (e) A right opening, which is the mirror image of the left opening.

(b) A threaded collar having internal threads sized to releasably attach to the threaded outside portion of the neck.

(c) A nipple having an annular flange, the flange carried between the rim of the neck and the threaded collar.

(d) A stopper for preventing the passage of fluid from one side of the bottle. The stopper provides:
  (a) A half-round side, sized to frictionally fit against the inside portion of the cylindrical neck of the bottle.
  (b) A flat side, sized to frictionally fit against the divider.
  (c) A bottom side. The bottom side is next to the liquid, when the stopper is inserted into either the left or right opening of the cylindrical neck.
  (d) A top side. And,
  (e) A sloping top portion. The sloping portion may have a shoulder or a lip portion in contact with the center divider, the lip portion sized to fit over the center divider.

(e) A handle for pulling the stopper out of an opening in the bottle. The handle provides:
  (a) A ring, or other tab-like element, that may be easily grasped by a user, but that is difficult for a child to grasp.
  (b) A stem, attached to the ring. And,
  (c) An anchor, attached to the stem and to the stopper. And, (f) A cover having a circular open end with a rim. The rim is incrementally greater in diameter than the outside diameter of the threaded collar. As a result, the rim is suitably sized to engage the threaded collar in a releasable, snap-on/snap-off, fit.

It is therefore a primary advantage of the present invention to provide a novel two-sided baby bottle that provides side-by-side liquid-containing cavities and is suitable for carrying 4 to 8 ounces of milk while carrying 4 to 8 ounces of juice.

Another advantage of the present invention is to provide a more economical means for a parent to carry two types of liquid than to carry two baby bottles.

A still further advantage of the present invention is to provide a more convenient means for a parent to carry two types of liquid than to carry two baby bottles.

A still further advantage of the present invention is to provide a leak-proof baby bottle capable of carrying two fluids at the same time.

A still further advantage of the present invention is to provide a two-fluid carrying baby bottle having a stopper connected to the nipple, which prevents the stopper from being pushed into the fluid cavity.

A still further advantage of the present invention is to provide a two-fluid carrying baby bottle having a ring or tab that allows the user to pull the stopper out of the opening of a fluid cavity.

DRAWINGS

These and other features, aspects, and advantages of the present invention will become better understood with regard to the following description, appended claims, and accompanying drawings where:

DESCRIPTION

Figure 1:
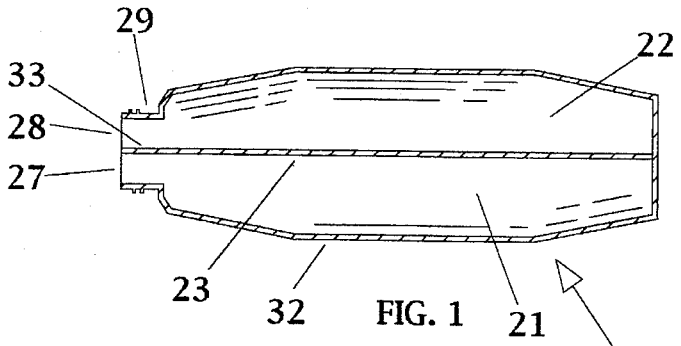
FIG. 1 shows a lengthwise cross-section of the bottle showing the center divider in cross-section.

A two-sided baby bottle provides two fluid containing sides, allowing two fluids, such as milk and juice, to be carried in a single baby bottle and dispensed through a single nipple. A two-sided bottle 20 allows the user to store two fluids, or to dispense one fluid while the other is stored for later use. A nipple 60 carries a stopper 70. The stopper may be used to prevent fluid flow from a cavity on a first side of the bottle, while the nipple allows fluid flow from a cavity on a second side of the bottle. Handle means 80, carried by the stopper 70, allows the user to easily remove the stopper. A threaded collar 40 releasably holds the nipple in place, and prevents leakage. A cover 50 keeps the nipple clean when not in use, and is easily removed for use.

Figure 2:
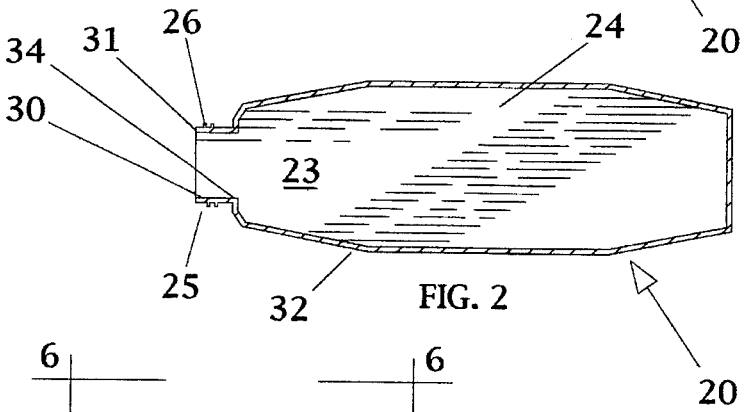
FIG. 2 shows a lengthwise cross-section of the bottle showing the center divider in the same plane as the paper.

As seen in FIG. 1, the two-sided bottle 20 provides a body portion 32 that is separated into two halves by a center divider 23. The lengthwise center divider 23, as seen in FIGS. 1 and 2, divides the bottle and cylindrical neck in the lengthwise direction, in that the center axis running the length of the bottle is located within the plane of the center divider. The center divider 23 typically divides the bottle into a left cavity 21 and a right cavity 22 having approximately equal volume. The neck 25 of the bottle 20 is attached to one end of the body 32 and is generally cylindrical in shape, providing a circular rim 31, an inside portion 34 and an outside portion 29. Threads 26 are provided on the outside portion 29 of the neck 25, as seen in FIGS. 1, 2, 5, and 8. The center divider 23 also divides the neck 25 into a left opening 27 and a right opening 28. The openings 27, 28 are half-circles in shape, having a round, half-circle side 30 and a flat side 33. The half-circle side 30 is formed by the inside portion 34 of the neck 25, while the flat side 33 is formed by one side of the center divider 23.

FIG. 2 shows the two-sided bottle 20 oriented so that the center divider 23 is in the same plane as the paper. The center divider is a fiat, planar surface, having the two-dimensional shape and appropriate size as determined by the cross-section of the body 32 and neck 25 of the bottle 20. The perimeter 24 of the divider 23 attaches to the inside wall of the body 32 of the bottle 20, making a fluid-tight connection.

Figure 7:
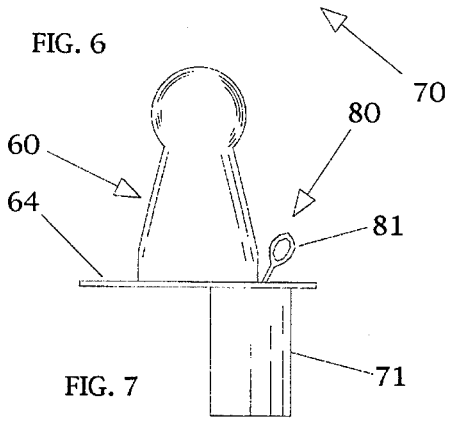
FIG. 7 shows an end-view of the nipple with attached stopper, along with the ring version of the handle means for pulling the stopper out of an opening in the two-sided bottle.

FIG. 7 shows a end-view of the nipple 60 and attached stopper 70. The nipple is well-known in the prior art, and provides a somewhat conical side wall 61, and a generally bulbous or spherical tip 62 having a fluid dispensing opening 63. An annular flange 64 is circular in shape, having a concentric opening which is sized to attach to the side wall 61.

Figure 9:
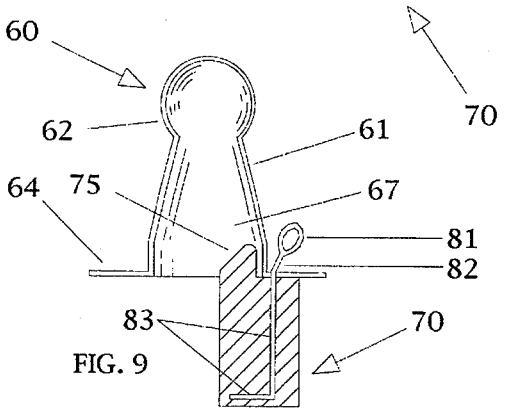
FIG. 9 shows a cross-sectional view of the nipple, attached stopper and handle of FIG. 7.

The stopper 70 is attached to the bottom surface of the annular flange 64 of the nipple 60, as seen in FIGS. 7 and 9, by adhesive, or alternately by other fasteners such as a modified rivet or other suitable fastener. The means of attachment of the stopper should be calculated to prevent leakage from inside the nipple to the outside environment. The stopper 70 is formed of a flexible, fluid-proof mass, that is typically made of a rubber-like plastic. The stopper 70 provides a half circle side 71 and a flat side 72. Therefore, taken in cross section perpendicular to an axis in the lengthwise direction of the bottle, the cross-section of the stopper is a half-circle. The stopper 70 also provides a bottom side 73 and a top side 74.

FIG. 9 shows a cross-sectional end-view of the nipple 60 and a first version of the stopper 70. A sloping top portion 75 extends slightly into the body 67 of the nipple 60. The sloping top portion 75 functions by preventing liquid from pooling above the stopper 70, and therefore reduces the chance of mixing the two liquids when the stopper is removed.

Figure 5:
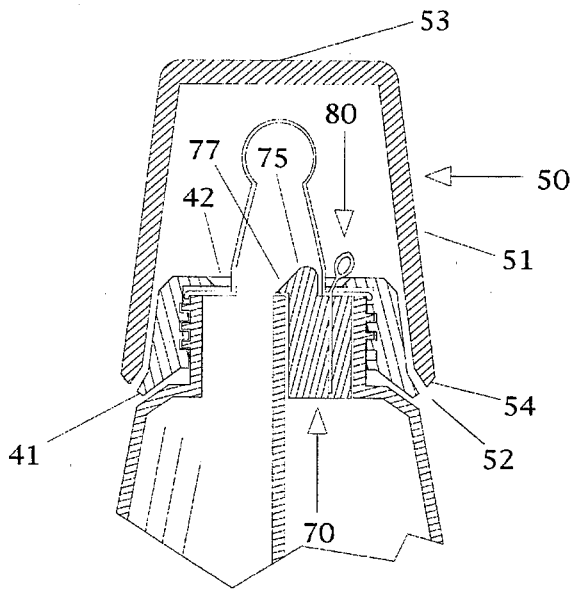
FIG. 5 shows a cross-sectional view of the bottle, with the center divider in cross-section, the threaded collar, the cover, the nipple and the stopper.

FIG. 5 shows a cross-sectional end-view of the nipple 60 and a second version of the stopper 70. The sloping top portion 75 of the stopper 70 provides a shoulder 77 which makes a fluid-tight seal with the center divider 23 when the stopper is inserted into a neck opening 27, 28.

Figure 8:
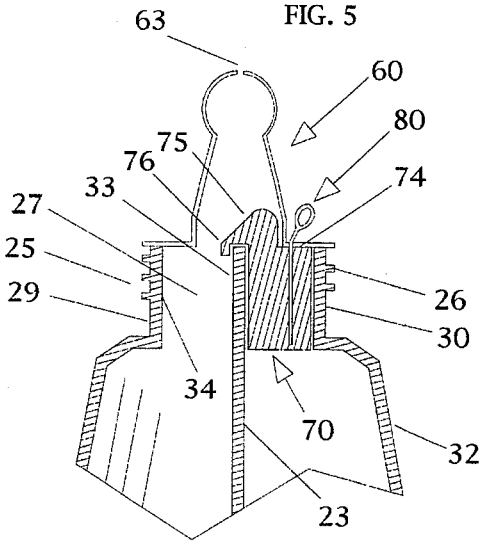
FIG. 8 shows a cross-sectional view of the two-sided bottle with the nipple and attached stopper in position.

FIG. 8 shows a cross-sectional end-view of the nipple 60 and a third version of the stopper 70. The sloping top portion 75 of the stopper 70 provides a lip 76 that is sized to fit over the center divider 23 and which provides a fluid-tight seal.

Handle means 80, seen in FIGS. 3–5 and 7–9, comprises a ring 81 having a stem 82 and an anchor 83. The handle means 80, which may alternately be embodied by any suitable type of tab or other grip, functions to allow the user to pull the stopper 70 out of the opening 27, 28 when desired. The ring 81, or any tab-like structure, should be sized to easy to grip between thumb and forefinger, and yet small enough that an infant is unable to grasp it. The ring 81, stem 82 and anchor 83 may be made of wire or lightweight nylon string. As seen in FIG. 9, anchor 83 may be wound, bent, or curled inside the stopper 70 to prevent the ring 81, stem 81, and anchor 83 from being accidentally pulled out of the stopper 70.

Figure 3:
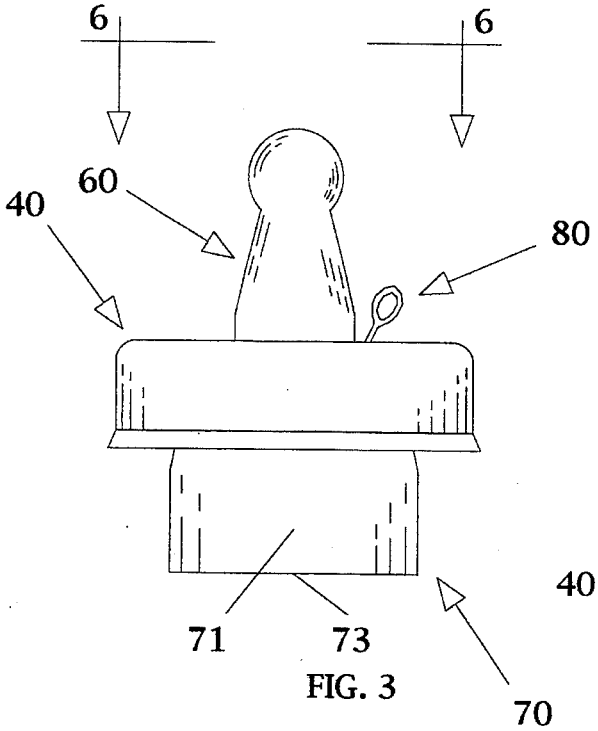
FIG. 3 shows a side-view of the :nipple with attached stopper inserted into the threaded collar.

FIG. 3 is a side-view of the nipple 60 and attached stopper 70, along with threaded collar 40. The threaded collar 40 is similar or identical to prior art threaded collars, and provides an annular body 41 with an upper opening 42 through which the nipple 60 protrudes. A lower opening 43 allows the neck 25 of the bottle 20 to enter.

Figure 4:
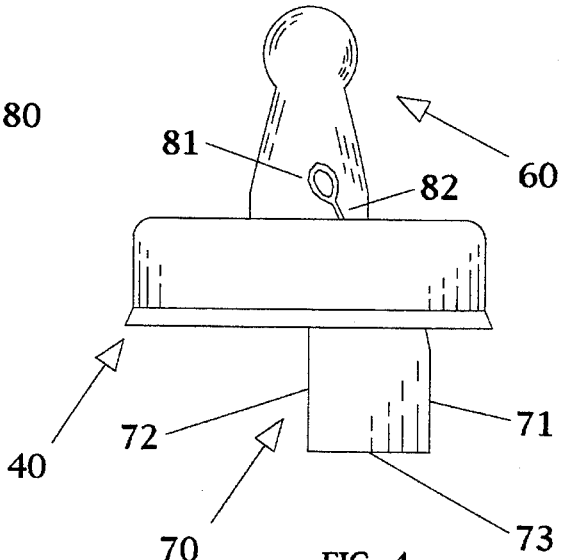
FIG. 4 shows an end-view of the nipple with attached stopper inserted into the threaded collar.

FIG. 4 is a end-view of the nipple 60 and attached stopper 70, along with threaded collar 40.

Figure 6:
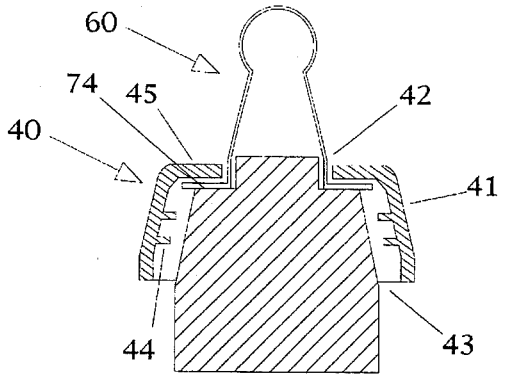
FIG. 6 shows a cross-sectional view of the threaded collar, and the nipple with attached stopper.

FIG. 6 is a cross-sectional side-view of the nipple 60 and attached stopper 70, along with the threaded collar 40. The internal threads 44 of the threaded collar 40 are seen, as well as the upper opening 42 and the lower opening 43. When the collar 40 is threaded onto the neck 25, an end plate 45 holds annular flange 64 of nipple 60 against rim 31 of neck 25.

FIG. 8 is a cross-sectional side-view of the nipple 60, attached stopper 70, and two-sided bottle 20. The stopper is inserted into the right opening 28 of the two-sided bottle 20, leaving the left opening 27 open, allowing fluid to flow from the left cavity 21 to the nipple 60.

FIG. 5 is similar to FIG. 8, but with the addition of the threaded collar 40 and the cover 50. Cover 50 is similar or the same as prior art covers, and provides a conical wall 51, a circular open end 52, and a circular closed end 53. A rim 54 allows the cover to be snapped-on and snapped-off the threaded collar in a manner that is well-known.

To use the baby bottle of the invention, the user first removes the cover 50. The user then unscrews the threaded collar 40 and removes that collar. By gently pulling on handle 80, the user is able to remove stopper 70 from the opening 27 or 28. A first fluid, such as milk, is then added to the right cavity 22 by means of the right opening 28. A second fluid, such as juice, is then added to the left cavity 21 by means of the left opening 27. The stopper 70 is then gently forced into either the left opening 27 or the right opening 28. This action results in the placement of the annular flange 64 of the nipple 60 on the rim 31 of the neck 25 of the two-sided bottle 20. The threaded collar 40 is then screwed back on. End plate 45 causes flange 64 to make a fluid-tight seal with rim 31 of neck 25. The bottle may then be given to a baby or the cover 50 snapped into place.

The previously described version of the present invention has many advantages, including structural means to carry two fluids in a compact and economical manner in one baby bottle. The bottle of the invention also provides the advantages of a stopper which allows a water-tight seal to be formed in one opening of the bottle, while allowing fluid to be removed from the other opening. The two-sided bottle of the invention also provides the advantage of a handle means, typically comprising a graspable ring, for removal of the stopper. The bottle of the invention also provides the advantage of a one-piece nipple and stopper, so that the stopper cannot be inserted all the way into the cavity 21, 22, since it is attached to the nipple.

Although the present invention has been described in considerable detail and with reference to certain preferred versions, other versions are possible. For example, the ring 81 may be replaced by a tab or some other graspable handle-like structure. The shape and exact dimensions of the body of the bottle, the threaded collar, cover and nipple all may be varied. If the dimensions of the two-sided bottle are varied, the stopper will also, naturally, vary to accommodate the openings in the bottle. Therefore, the spirit and scope of the appended claims should not be limited to the description of the preferred versions contained here.

What is claimed is:

1. A baby bottle, comprising:

(a) a two-sided bottle comprising:
  (a) a body;
  (b) a lengthwise center divider having a perimeter, the perimeter attached to the body, thereby dividing the body into a left cavity and a right cavity; and
  (c) a cylindrical neck, divided by the lengthwise center divider, and attached to the body of the two-sided bottle, comprising:
    (a) an inside portion and an outside portion;
    (b) a rim;
    (c) threads on the outside portion;
    (d) a left opening; and
    (e) a right opening;

(b) a threaded collar having threads sized to releasably attach to the threaded outside portion of the neck;

(c) a nipple having an annular flange, the flange carried between the rim of the neck and the threaded collar;

(d) stopper means, attached to the nipple and removably carried by either of the openings in the cylindrical neck, for preventing the passage of fluid from one side of the bottle; and (e) handle means for pulling the stopper means out of either of the openings in the neck of the bottle.

2. The baby bottle of claim 1, further comprising:

(a) a cover having a circular open end with a rim incrementally greater in diameter than the outside diameter of the collar, whereby the rim is suitably sized to engage the threaded collar in a releasable fit.

3. The baby bottle of claim 1, in which the stopper means comprises a flexible, fluid-proof mass, additionally comprising:

(a) a half circle side, sized to frictionally fit against the inside portion of the cylindrical neck of the bottle;

(b) a flat side, sized to frictionally fit against the center divider;

(c) a bottom side;

(d) a top side; and (e) a sloping top portion having a lip sized to fit over the center divider.

4. The baby bottle of claim 3, in which the handle means comprises:

(a) a ring;

(b) a stem, attached to the ring; and (c) an anchor, attached to the stem and to the stopper means.

5. The baby bottle of claim 1, in which the stopper means comprises a flexible, fluid-proof mass, additionally comprising:

(a) a half circle side, sized to frictionally fit against the inside portion of the cylindrical neck of the bottle;

(b) a flat side, sized to frictionally fit against the center divider;

(c) a bottom side;

(d) a top side; and (e) a sloping top portion having a shoulder which makes a fluid-tight seal with the center divider.

6. The baby bottle of claim 1, in which the stopper means comprises a flexible, fluid-proof mass, additionally comprising:

(a) a half circle side, sized to frictionally fit against the inside portion of the cylindrical neck of the bottle;

(b) a flat side, sized to frictionally fit against the center divider;

(c) a bottom side;

(d) a top side; and (e) a sloping top portion which extends slightly into a body portion of the nipple, thereby preventing the liquid from pooling above the stopper means.

7. A baby bottle, comprising:

(a) a two-sided bottle comprising:
  (a) a body;
  (b) a lengthwise center divider having a perimeter, the perimeter attached to the body, thereby dividing the body into a left cavity and a right cavity; and
  (c) a cylindrical neck, divided by the lengthwise center divider, and attached to the body of the two-sided bottle, comprising:
    (a) an inside portion and an outside portion;
    (b) a rim;
    (c) threads on the outside portion;
    (d) a left opening; and
    (e) a right opening;

(b) a threaded collar having internal threads sized to releasably attach to the threaded outside portion of the neck;

(c) a nipple having an annular flange, the flange carried between the rim of the neck and the threaded collar, (d) stopper means, attached to the nipple and removably carried by either of the openings in the cylindrical neck, for preventing the passage of fluid from one side of the bottle, comprising a flexible, fluid-proof mass, which comprises:

(a) a half circle side, sized to frictionally fit against the inside portion of the cylindrical portion of the neck of the bottle;

(b) a flat side, sized to frictionally fit against the center divider;

(c) a bottom side;

(d) a top side; and (e) a sloping top portion having a lip sized to fit over the center divider;

(e) handle means for pulling the stopper means out of either of the openings in the cylindrical neck of the bottle, comprising:

(a) a ring;

(b) a stem, attached to the ring; and (c) an anchor, attached to the stem and to the stopper, and (f) a cover, comprising:

(a) a conical wall;

(b) a circular closed end, attached to the conical wall; and (c) a circular open end with a rim incrementally greater in diameter than the outside diameter of the collar, whereby the rim is suitably sized to engage the threaded collar in a releasable fit.

* * * * *